US008939050B2

(12) United States Patent
Chen

(10) Patent No.: US 8,939,050 B2
(45) Date of Patent: Jan. 27, 2015

(54) DRIVING HEAD WITH AN ELASTIC BUCKLE

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 200 days.

(21) Appl. No.: 13/781,534

(22) Filed: Feb. 28, 2013

(65) Prior Publication Data

US 2014/0238205 A1 Aug. 28, 2014

(51) Int. Cl.

| | |
|---|---|
| ***B25B 13/06*** | (2006.01) |
| ***B25B 23/00*** | (2006.01) |
| ***B25B 13/46*** | (2006.01) |
| ***B25B 23/10*** | (2006.01) |

(52) U.S. Cl.

CPC ..... *B25B 23/0035* (2013.01); *B25B 13/06* (2013.01); *B25B 13/463* (2013.01); *B25B 23/108* (2013.01)

USPC ..... 81/125; 81/438; 81/452

(58) Field of Classification Search

USPC ..... 81/438, 125, 124.3, 124.7, 452; 279/79, 279/102

See application file for complete search history.

(56) References Cited

U.S. PATENT DOCUMENTS

| | | | | |
|---|---|---|---|---|
| 4,644,831 | A * | 2/1987 | Yang | 81/125 |
| 4,787,278 | A * | 11/1988 | Bononi | 81/438 |
| 5,042,333 | A * | 8/1991 | Huang | 81/438 |
| 5,724,872 | A * | 3/1998 | Shih | 81/125 |
| 5,943,923 | A * | 8/1999 | Shih | 81/125 |
| 6,082,229 | A * | 7/2000 | Shih | 81/125 |
| 6,170,363 | B1 * | 1/2001 | Hu | 81/125 |
| 6,178,854 | B1 * | 1/2001 | Shih | 81/125 |
| 6,968,758 | B2 * | 11/2005 | Lin | 81/438 |
| 7,131,358 | B2 * | 11/2006 | Hsien | 81/438 |
| 8,864,143 | B2 * | 10/2014 | Lin | 279/23.1 |
| 2012/0126497 | A1 * | 5/2012 | Lin | 279/155 |

* cited by examiner

*Primary Examiner* — David B Thomas

(57) ABSTRACT

A driving head with an elastic buckle includes a driving head having an engaging room which has a first limiting slot and a second limiting slot, an elastic buckle being assembled with the engaging room and having a connecting segment, a first abutting segment and a second abutting segment, the first abutting segment and the second abutting segment being received in the first limiting slot and the second abutting slot respectively, the first abutting segment having a first abutting portion slightly bent inwardly. Under this arrangement, the first abutting segment and the second abutting segment abut against an outer periphery of a tool bit, so that the tool bit does not depart from the engaging room easily during operation.

9 Claims, 9 Drawing Sheets

DRIVING HEAD WITH AN ELASTIC BUCKLE

BACKGROUND OF THE INVENTION

1. Field of the Invention

The present invention relates to a driving head, and more particularly to a driving head with an elastic buckle in which the elastic buckle does not depart from an engaging room thereof when a user changes a tool head.

2. Description of Related Art

A conventional driving head with a positioning member comprises a driving head which has a stepped outline. The driving head is divided into two portions. An assembling portion is formed on one of the two portions of the driving head. An engaging groove is recessed inwardly in the assembling portion for engaging with a tool bit. A positioning member is assembled in a predefined segment of the assembling portion, so that the tool bit does not depart from the engaging groove during the operation. A flange is defined on the assembling portion and nears to the engaging groove. The positioning member is U-shaped. The engaging groove has an engaging slot defined therein. A shape of the engaging slot corresponds to another shape of the positioning member. The positioning member is received in the engaging slot. Under this arrangement, the tool bit is engaged with the engaging groove securely because the positioning member abuts against an outer periphery of the tool bit.

However, the conventional driving head with a positioning member has one disadvantage described as following.

When the tool bit is departed from the engaging groove, the positioning member is moved with the movement of the tool bit easily, and the user has to repeatedly reassemble the positioning member with the engaging groove, so that the user operates the conventional driving head with a positioning member inconveniently.

The present invention has arisen to mitigate and/or obviate the disadvantages of the conventional.

SUMMARY OF THE INVENTION

The main objective of the present invention is to provide a driving head with an elastic buckle.

To achieve the objective, a driving head with an elastic buckle comprises a driving head and an elastic buckle, the driving head having an engaging room defined therein, the engaging room having a first limiting slot and a second limiting slot recessed therein, the first limiting slot has a first limiting hole opened therethrough, the elastic buckle being assembled with the engaging room, the elastic buckle having a connecting segment, a first abutting segment and a second abutting segment, the first abutting segment being received in the first limiting slot, the second abutting segment being received in the second abutting slot, the first abutting segment and the second abutting segment connecting to two ends of the connecting segment respectively, the first abutting segment having a first abutting portion defined thereon which is slightly bent inwardly. Wherein, the first limiting slot is opposite to the second limiting slot; the first limiting slot and the second limiting slot are recessed from an opening of the engaging room toward a bottom of the engaging room; the second abutting segment further has a second abutting portion defined thereon which is slightly bent inwardly, so that the first abutting portion and the second abutting portion abut against the tool bit so as to prevent the tool bit from moving relative to the engaging room freely; the second limiting slot further has a second limiting hole opened thereon, so that when the second abutting segment is moved to the second limiting hole, another end of the elastic buckle is engaged with the second limiting hole so as to prevent the elastic buckle from thoroughly detaching from the engaging room; the engaging room further has an annular limiting groove defined around an inner wall thereof; the annular limiting groove communicates with the first limiting slot and the second limiting slot separately; the first abutting portion of the first abutting segment is bent toward the engaging room as arc-shaped; the first abutting portion of the first abutting segment is bent toward the engaging room as V-shaped; the second abutting portion of the second abutting segment is bent toward the engaging room as arc-shaped; the second abutting portion of the second abutting segment is bent toward the engaging room as V-shaped. Under this arrangement, the first abutting segment and the second abutting segment abut against an outer periphery of a tool bit, so that the tool bit does not depart from the engaging room easily during operation; when the tool bit is departed from the engaging room, the elastic buckle does not depart from the engaging room easily because one end of the elastic buckle is engaged with the first limiting hole.

Further benefits and advantages of the present invention will become apparent after a careful reading of the detailed description with appropriate reference to the accompanying drawings.

DETAILED DESCRIPTION OF THE INVENTION

Figure 1:
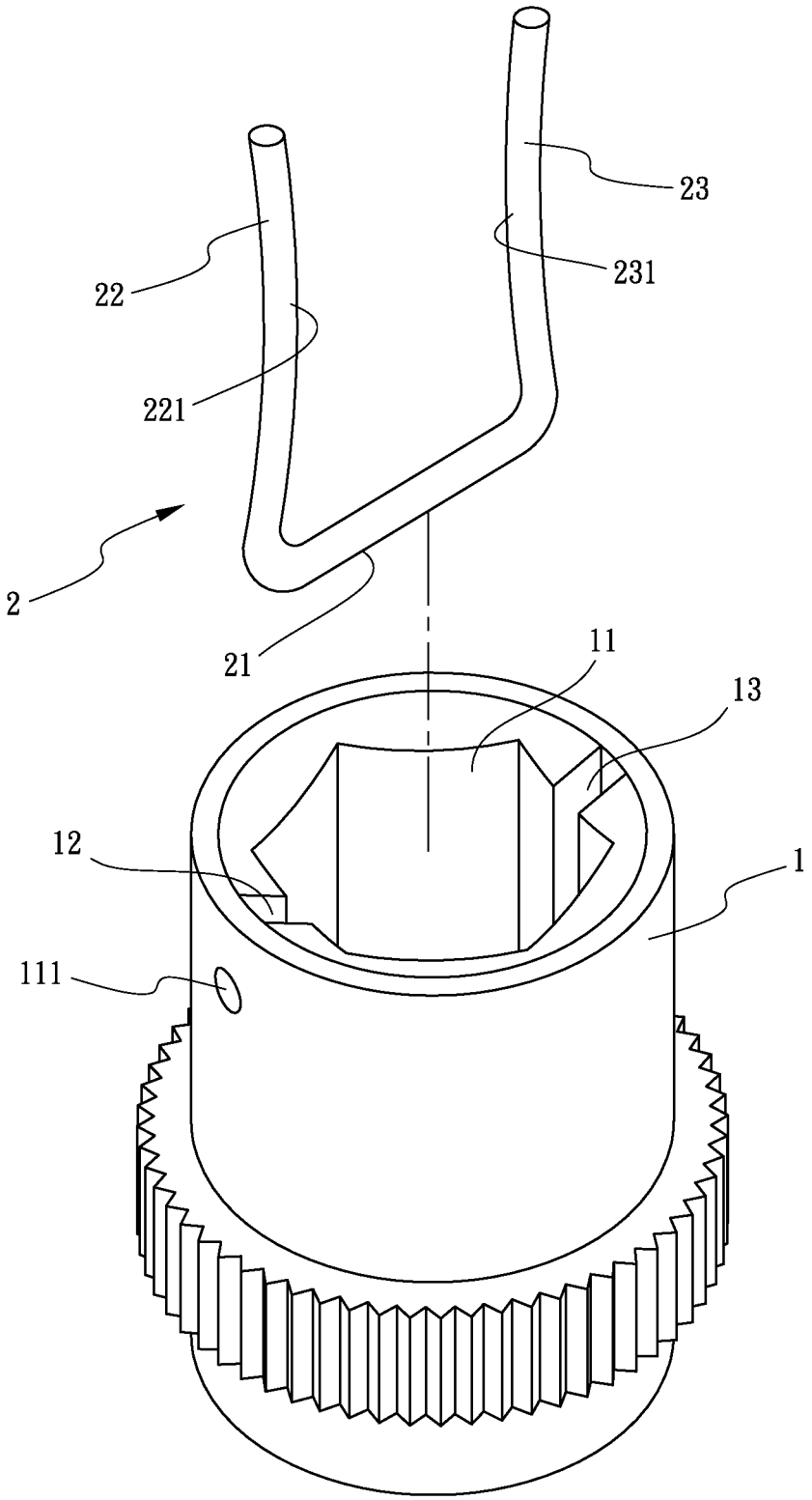
FIG. 1 is an exploded view of a driving head with an elastic buckle of the present invention.
Figure 2:
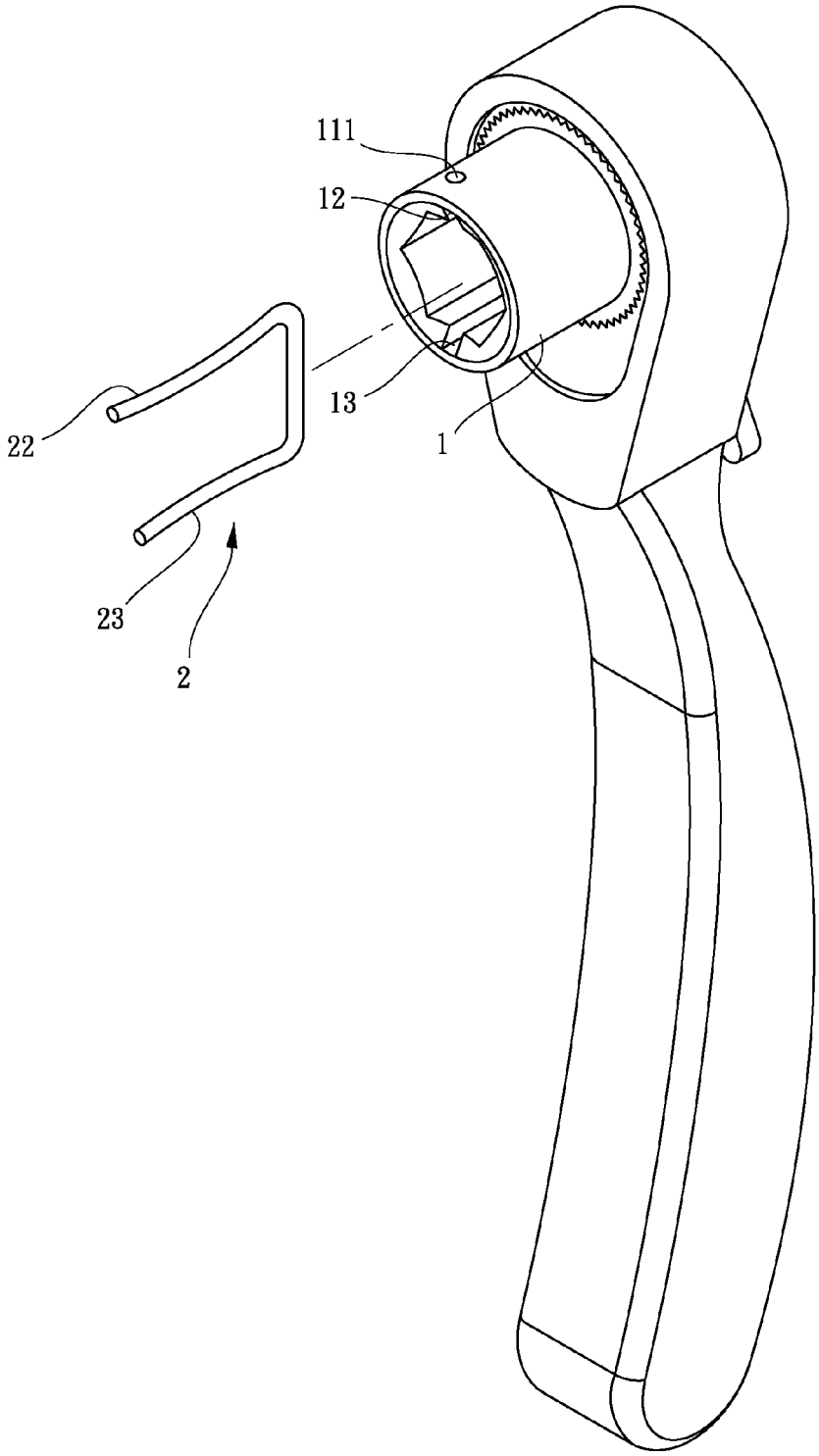
FIG. 2 is an exploded view for showing the present invention is assembled to a wrench.
Figure 3:
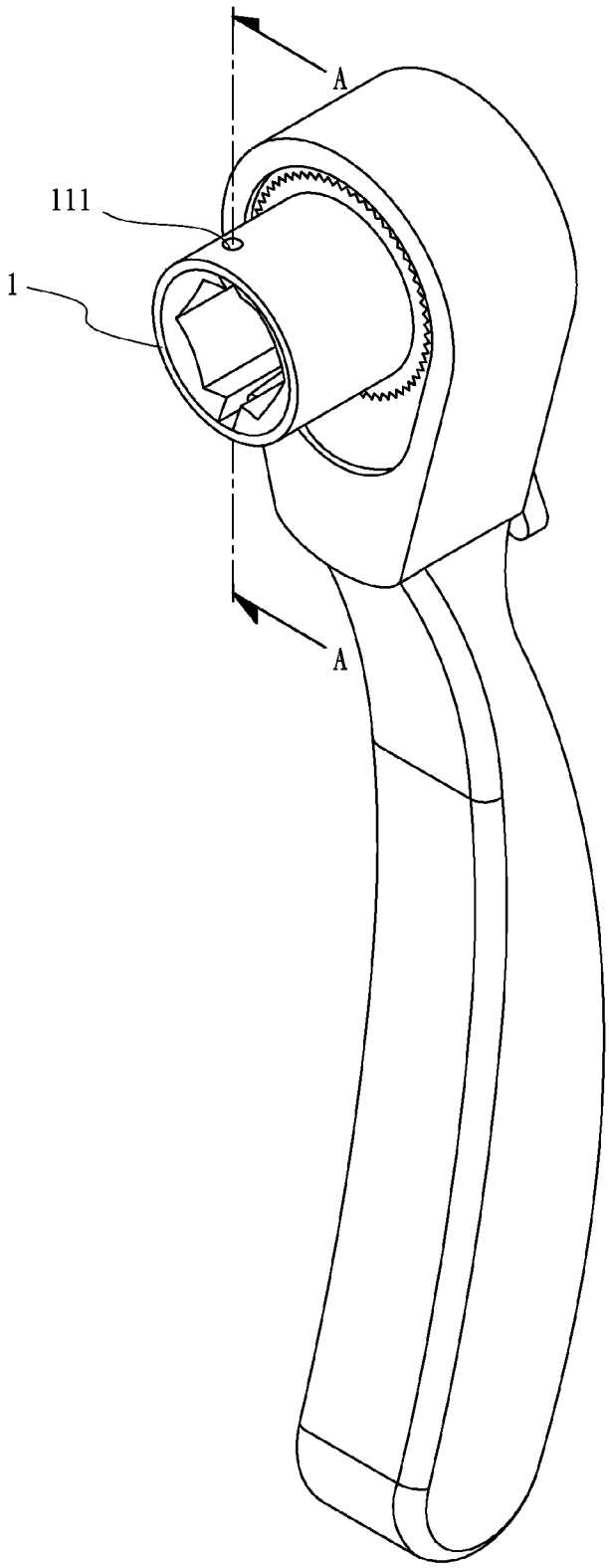
FIG. 3 is a perspective view for showing the present invention is assembled to the wrench.

Referring to FIGS. 1-5, a driving head with an elastic buckle comprises a driving head 1 and an elastic buckle 2. The driving head 1 has an engaging room 11 defined therein. The engaging room 11 has a first limiting slot 12 and a second limiting slot 13 recessed therein. The first limiting slot 12 has a first limiting hole 111 opened therethrough. The elastic buckle 2 is assembled with the engaging room 11. The elastic buckle 2 is U-shaped. One end of the elastic buckle 2 is engaged with the first limiting hole 111. The elastic buckle 2 has a connecting segment 21, a first abutting segment 22 and a second abutting segment 23. The first abutting segment 22 is received in the first limiting slot 12. The second abutting segment 23 is received in the second abutting slot 13. The first abutting segment 22 and the second abutting segment 23 connect to two ends of the connecting segment 21 respectively. The first abutting segment 22 has a first abutting portion 221 defined thereon which is slightly bent inwardly. Under this arrangement, the first abutting segment 22 and the second abutting segment 23 abut against an outer periphery of a tool bit 3, so that the tool bit 3 does not depart from the engaging room 11 easily during operation; since one end of the elastic buckle 2 is engaged with the first limiting hole 111, the elastic buckle 2 does not depart from the engaging room 11 easily when the tool bit 3 is departed from the engaging room 11.

The detailed characteristics of the present invention are further described as following.

The first limiting slot 12 is opposite to the second limiting slot 13. The first limiting slot 12 and the second limiting slot 13 are recessed from an opening (not numbered) of the engaging room 11 toward a bottom of the engaging room 11.

The second abutting segment 23 further has a second abutting portion 231 defined thereon which is slightly bent inwardly, so that the first abutting portion 221 and the second abutting portion 231 abut against the tool bit 3 so as to prevent the tool bit 3 from moving relative to the engaging room 11 freely.

Figure 4:
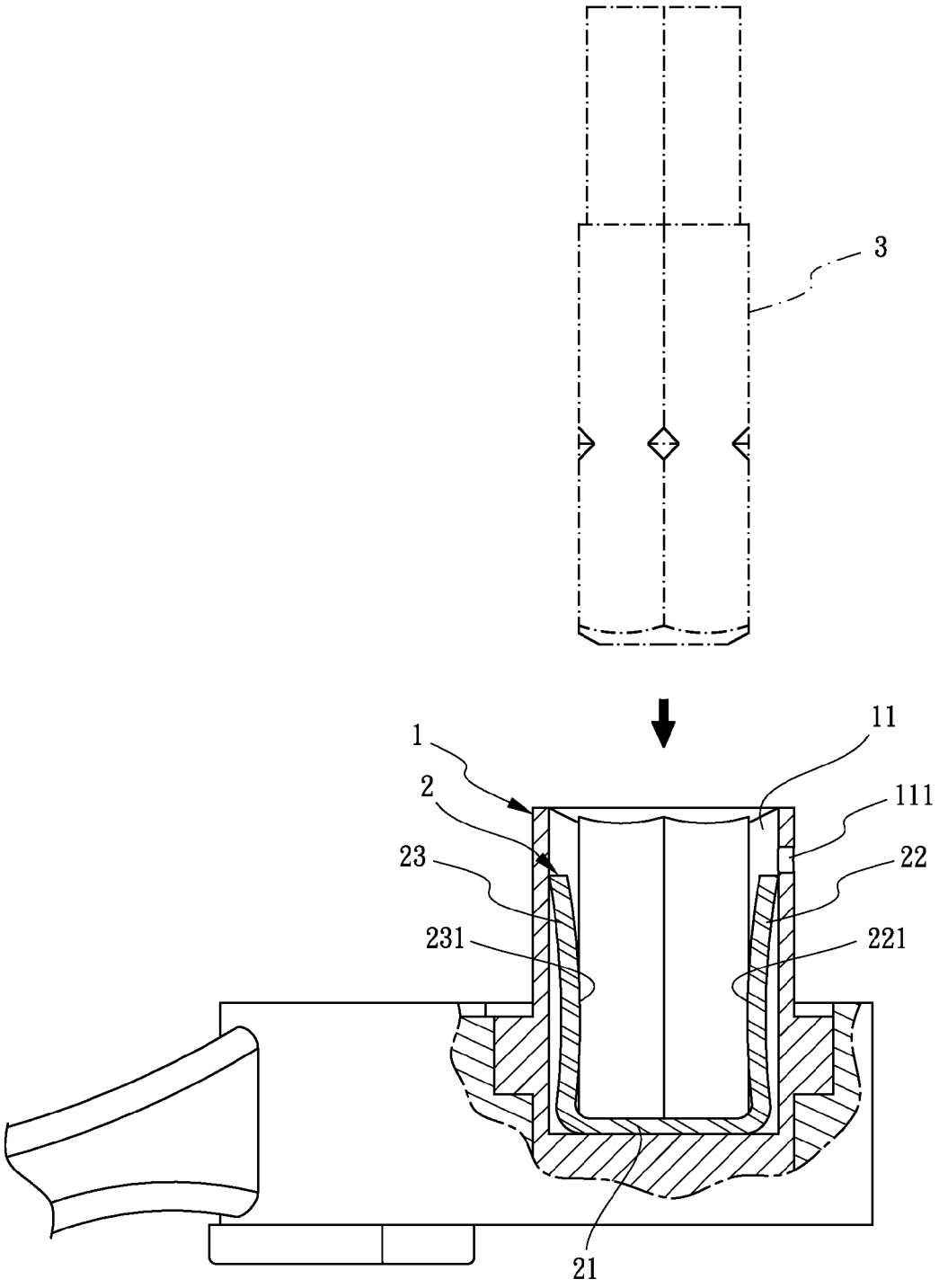
FIGS. 4, 5 and 6 are cross-sectional views along line A-A shown in FIG. 3 for showing a tool bit is going to be assembled with the present invention, the tool bit is assembled with the present invention, and the tool bit is detached from the present invention respectively.
Figure 5:
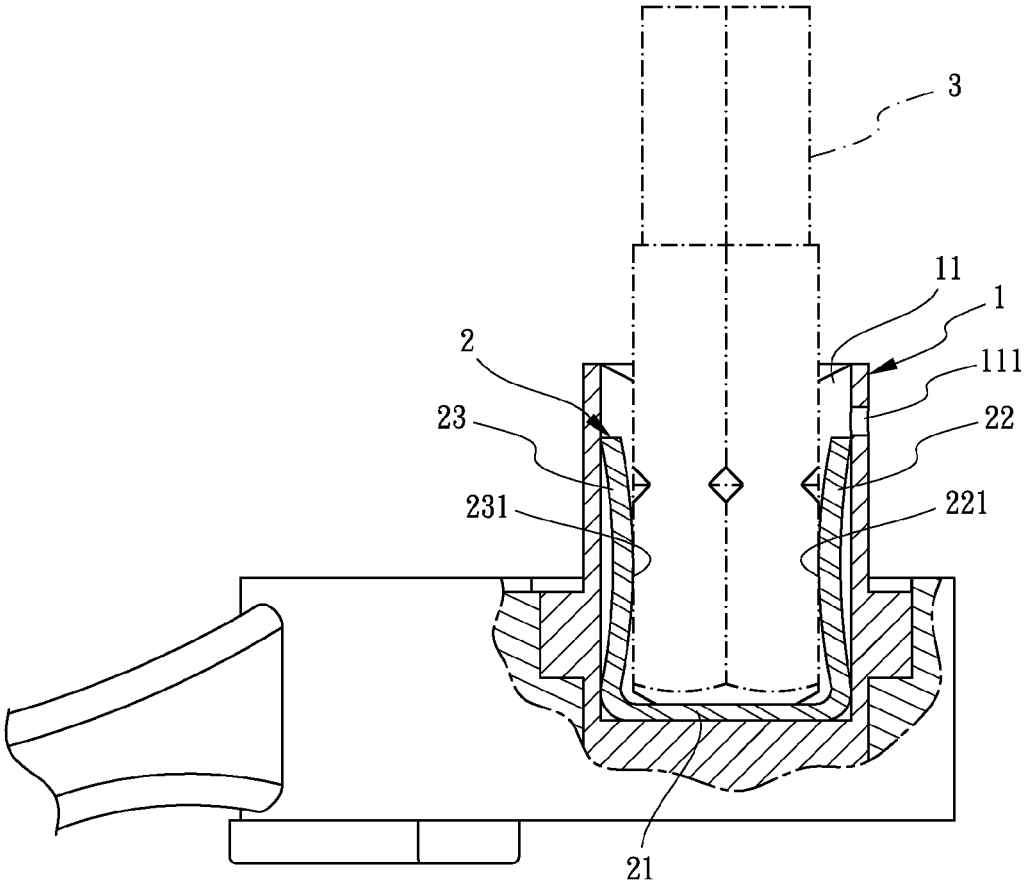
Figure 6:
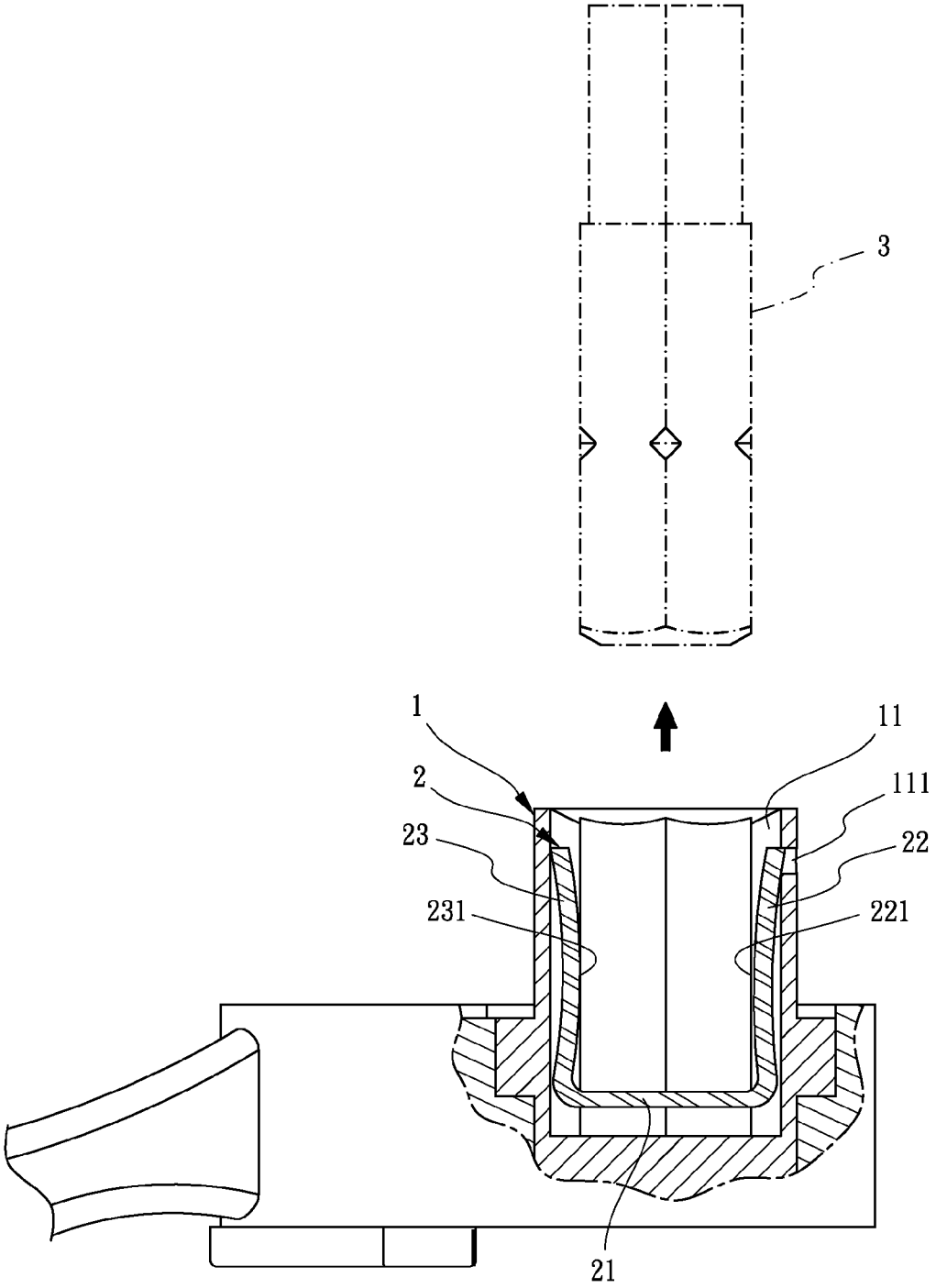

Referring to FIGS. 4-6, the elastic buckle 2 is assembled in the engaging room 11. The connecting segment 21 of the elastic buckle 2 is abutted against the bottom of the engaging room 11. The first abutting portion 221 of the first abutting segment 22 is bent toward the engaging room 11 as arc-shaped. A distance between one end of the elastic buckle 2 and the opening of the engaging room 11 is longer than another distance between the first limiting hole 111 and the opening of the engaging room 11. The second abutting portion 231 of the second abutting segment 23 is bent toward the engaging room 11 as arc-shaped. Therefore, when the tool bit 3 is assembled with the engaging room 11, the outer periphery of the tool bit 3 is abutted against the first abutting portion 221 of the first abutting segment 22 and the second abutting portion 231 of the second abutting segment 23, wherein the first abutting segment 22 is opposite to the second abutting segment 23 so as to abut against the tool bit 3 uniformly, so that the tool bit 3 does not depart from the engaging room 11 easily during operation.

As shown in FIG. 6, when the tool bit 3 is going to be departed from the engaging room 11, the tool bit 3 is pulled from the engaging room 11, so that the elastic buckle 2 is moved upward with the movement of the tool bit 3 because the elastic buckle 2 is securely abutted against the tool bit 3; meanwhile, the connecting segment 21 of the elastic buckle 2 is detached from the bottom of the engaging room 11; thereby, when one end of the elastic buckle 2 is moved to the first limiting hole 111 with the movement of the tool bit 3, the first abutting segment 22 is engaged with the first limiting hole 111, so that the elastic buckle 2 does not detach from the engaging room 11 thoroughly with the detachment of the tool bit 3.

Figure 7:
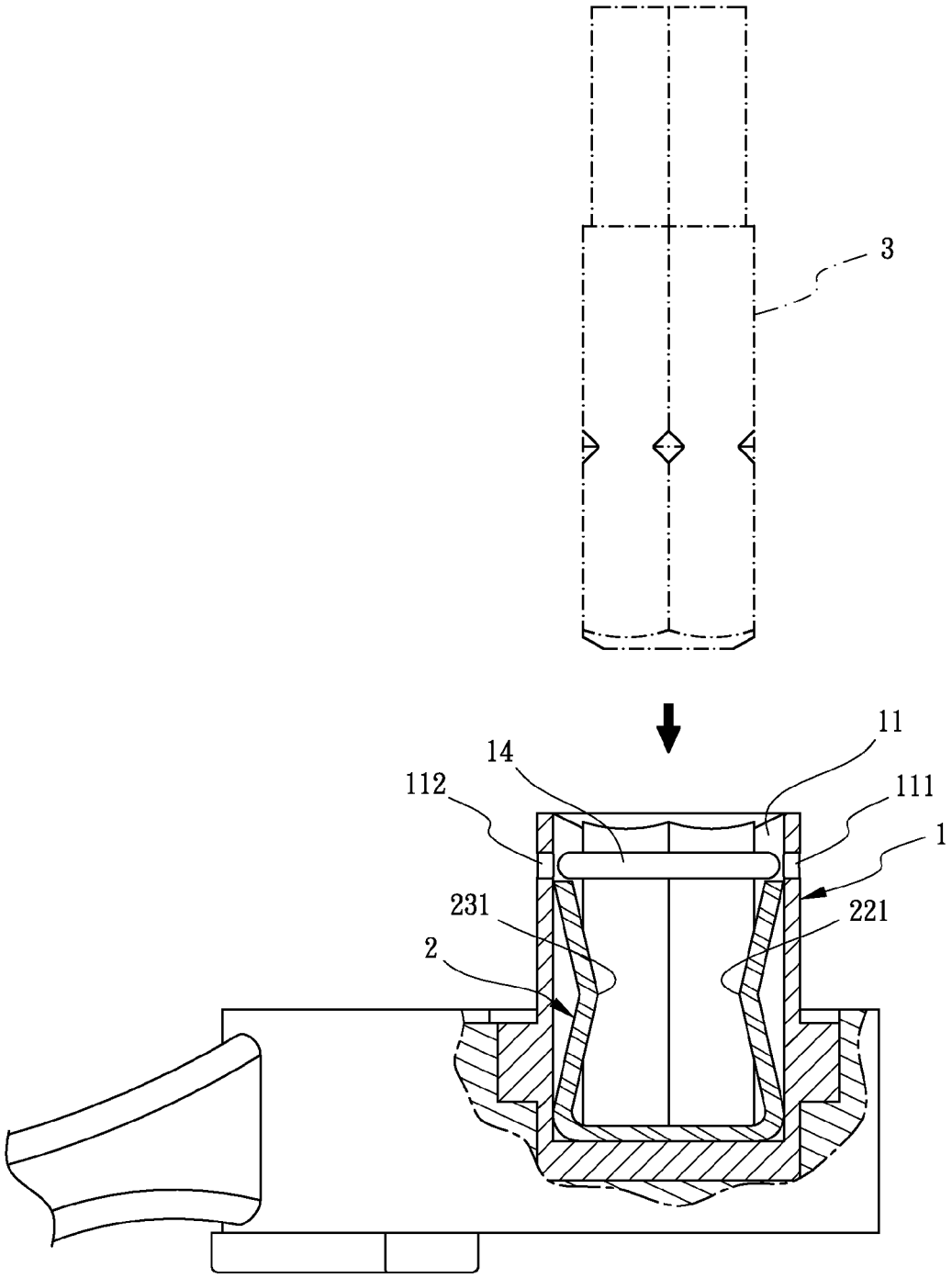
FIGS. 7, 8 and 9 are cross-sectional views for showing the tool bit is going to be assembled with the present invention, the tool bit is assembled with the present invention, and the tool bit is detached from the present invention respectively, in which the present invention has an annular groove defined therein.
Figure 8:
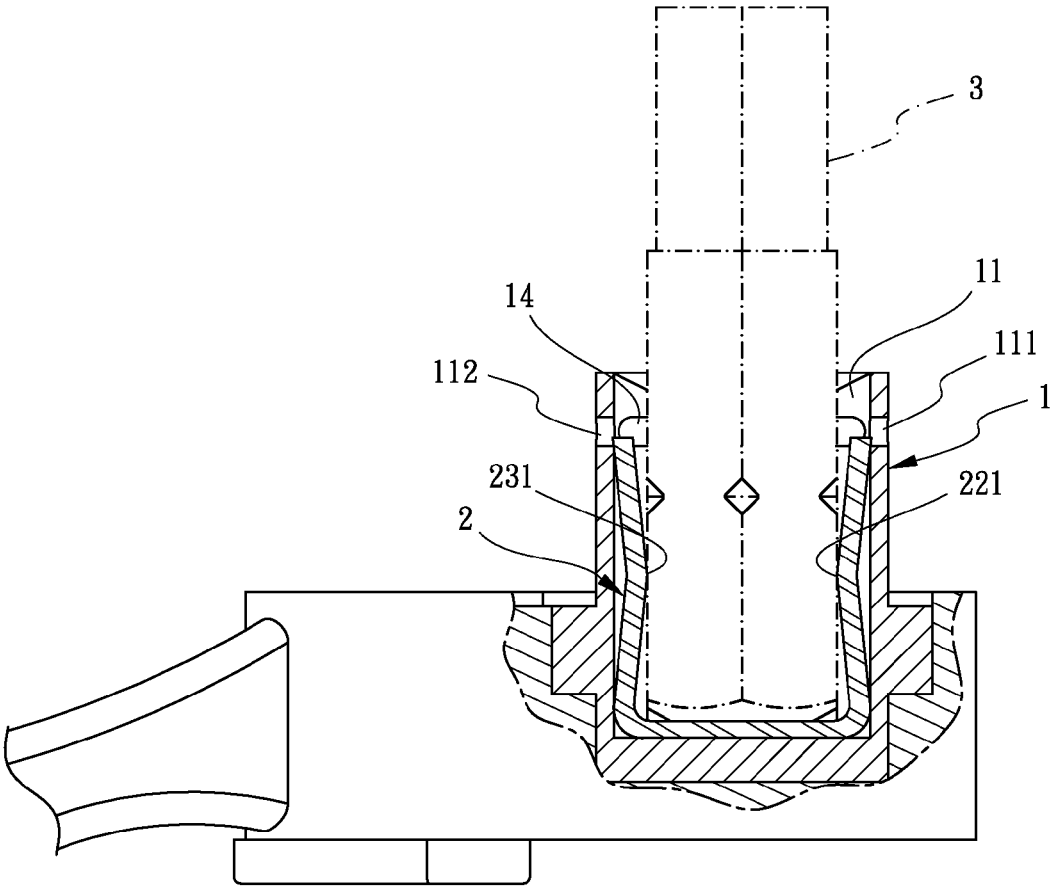
Figure 9:
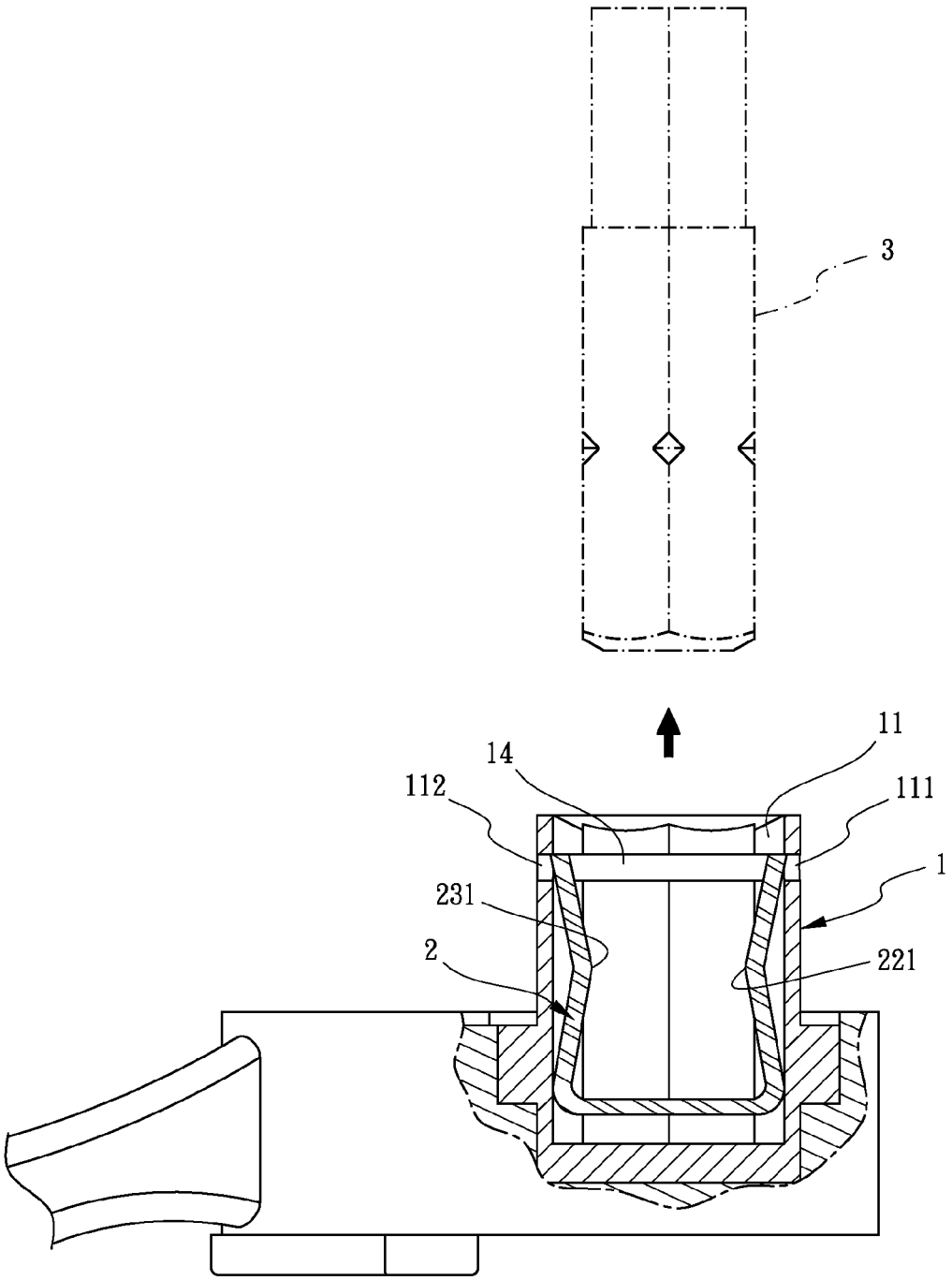

Referring to FIGS. 7-9, the second limiting slot 13 further has a second limiting hole 112 opened thereon, so that when the second abutting segment 23 is moved to the second limiting hole 112, another end of the elastic buckle 2 is engaged with the second limiting hole 112 so as to prevent the elastic buckle 2 from thoroughly detaching from the engaging room 11, so that a user operates the present invention conveniently.

Referring to FIGS. 7-9, the engaging room 11 further has an annular limiting groove 14 defined around an inner wall thereof. The annular limiting groove 14 communicates with the first limiting slot 12 and the second limiting slot 13 separately. The annular limiting groove 14 overlaps with the first limiting slot 12 and the second limiting slot 13. Therefore, the elastic buckle 2 is securely engaged with the engaging room 11 when the first abutting segment 22 and the second abutting segment 23 are received into the annular limiting groove 14.

Referring to FIG. 1 and FIG. 7, outlines of the first abutting segment 22 and the second abutting segment 23 are defined as a bent-shaped or as a V-shaped in which the first abutting segment 22 and the second abutting segment 2.3 bend toward the engaging room 11 respectively (The outlines of the first abutting segment 22 and the second abutting segment 23 are not limited by the present invention).

Although the invention has been explained in relation to its preferred embodiment, it is to be understood that many other possible modifications and variations can be made without departing from the spirit and scope of the invention as hereinafter claimed.

What is claimed is:

1. A driving head with an elastic buckle comprising:

a driving head and an elastic buckle, the driving head having an engaging room defined therein, the engaging room having a first limiting slot and a second limiting slot recessed therein, the first limiting slot has a first limiting hole opened therethrough; and the elastic buckle being assembled with the engaging room, the elastic buckle having a connecting segment, a first abutting segment and a second abutting segment, the first abutting segment being received in the first limiting slot, the second abutting segment being received in the second abutting slot, the first abutting segment and the second abutting segment connecting to two ends of the connecting segment respectively, the first abutting segment having a first abutting portion defined thereon which is slightly bent inwardly;

wherein the first abutting segment and the second abutting segment abut against an outer periphery of a tool bit, so that the tool bit does not depart from the engaging room easily during operation; when the tool bit is departed from the engaging room, the elastic buckle does not depart from the engaging room easily because one end of the elastic buckle is engaged with the first limiting hole.

2. The driving head with an elastic buckle as claimed in claim 1, wherein the first limiting slot is opposite to the second limiting slot; the first limiting slot and the second limiting slot are recessed from an opening of the engaging room toward a bottom of the engaging room.

3. The driving head with an elastic buckle as claimed in claim 2, wherein the engaging room further has an annular limiting groove defined around an inner wall thereof; the annular limiting groove communicates with the first limiting slot and the second limiting slot separately.

4. The driving head with an elastic buckle as claimed in claim 1, wherein the second abutting segment further has a second abutting portion defined thereon which is slightly bent inwardly, so that the first abutting portion and the second abutting portion abut against the tool bit so as to prevent the tool bit from moving relative to the engaging room freely.

5. The driving head with an elastic buckle as claimed in claim 4, wherein the second abutting portion of the second abutting segment is bent toward the engaging room as arc-shaped.

6. The driving head with an elastic buckle as claimed in claim 4, wherein the second abutting portion of the second abutting segment is bent toward the engaging room as V-shaped.

7. The driving head with an elastic buckle as claimed in claim 1, wherein the second limiting slot further has a second limiting hole opened thereon, so that when the second abutting segment is moved to the second limiting hole, another end of the elastic buckle is engaged with the second limiting hole so as to prevent the elastic buckle from thoroughly detaching from the engaging room.

8. The driving head with an elastic buckle as claimed in claim 1, wherein the first abutting portion of the first abutting segment is bent toward the engaging room as arc-shaped.

9. The driving head with an elastic buckle as claimed in claim 1, wherein the first abutting portion of the first abutting segment is bent toward the engaging room as V-shaped.

* * * * *